United States Patent [19]

Edelhoff et al.

[11] Patent Number: 5,064,332

[45] **Date of Patent: * Nov. 12, 1991**

[54] MOTOR-DRIVEN GARBAGE TRUCK COMPRISING A DETACHABLE CONTAINER

[75] Inventors: Gustav D. Edelhoff, Iserlohn, Fed. Rep. of Germany; Fred T. Smith, Palos Verdes Pen, Calif.

[73] Assignee: Edelhoff Polytechnik GmbH & Co., Iserlohn, Fed. Rep. of Germany

[ * ] Notice: The portion of the term of this patent subsequent to Dec. 29, 2004 has been disclaimed.

[21] Appl. No.: 464,648

[22] Filed: Jan. 11, 1990

Related U.S. Application Data

[63] Continuation of Ser. No. 108,811, Oct. 14, 1987, abandoned, which is a continuation-in-part of Ser. No. 733,865, May 1, 1985, Pat. No. 4,715,767.

[30] Foreign Application Priority Data

May 29, 1984 [DE] Fed. Rep. of Germany ..... 3420058

[51] Int. Cl.[5] ..... B66F 3/04

[52] U.S. Cl. ..... 414/408; 100/272; 100/286; 414/517

[58] Field of Search ..... 414/406–408, 414/509–517, 525.2, 525.4, 525.55, 525.6; 100/272, 286, 287

[56] References Cited

U.S. PATENT DOCUMENTS

| | | | |
|---|---|---|---|
| 25,161 | 8/1859 | Hand | 100/287 |
| 3,643,824 | 2/1972 | Partridge | 414/525 X |
| 3,844,209 | 10/1974 | Allbritton | 100/272 X |
| 3,921,839 | 11/1975 | Herpich | 414/408 |
| 3,937,140 | 2/1976 | Swanson | 100/286 X |
| 3,966,096 | 6/1976 | Worthington | 414/517 X |
| 4,041,799 | 8/1977 | Teti | 414/517 X |
| 4,544,320 | 10/1985 | Haines | 414/517 X |
| 4,552,500 | 11/1985 | Ghibaudo et al. | 414/517 X |
| 4,648,775 | 3/1987 | Verner | 414/513 |
| 4,715,767 | 12/1987 | Edelhoff et al. | 414/408 |

FOREIGN PATENT DOCUMENTS

| | | | |
|---|---|---|---|
| 383656 | 9/1973 | U.S.S.R. | 414/517 |

*Primary Examiner*—David A. Bucci
*Attorney, Agent, or Firm*—Morgan & Finnegan

[57] ABSTRACT

There is disclosed a motor-driven garbage truck provided with a detachable garbage container equipped with releasable coupling elements, and also having permanently mounted thereon a pouring unit which includes a pouring chute, lifting and tipping apparatus for picking up a garbage can and discharging the contents thereof into the chute which leads to a receiving space, and a conveying and compacting apparatus including a compacting platen and which apparatus is driven by crossing hydraulic piston-cylinder units for transferring the garbage from the receiving space into the container through a receiving opening that is provided with a cover plate joined to the upper edge of the compacting platen and which is guided in tracks located above the driver's cab.

3 Claims, 9 Drawing Sheets

A
B 5
4
3
2
1
80
78
79
76
10
77
81
75
82
46
9
26
83
84
14
19

MOTOR-DRIVEN GARBAGE TRUCK COMPRISING A DETACHABLE CONTAINER

This application is a continuation of application Ser. No. 07/108,811, filed Oct. 14, 1987, now abandoned, which is a continuation-in-part of application Ser. No. 06/733,865, filed May 15, 1985, now U.S. Pat. No. 4,715,767 of Dec. 29, 1987.

BACKGROUND OF THE INVENTION

A garbage truck is known from German Patent Specification 24 58 903 in which there is disclosed a system for collecting garbage in detachable containers and transporting the garbage-filled containers to a central container-handling station where the filled containers are aced by empty ones, and from which station the filled containers are transported by forwarding trucks to the dumps. The known garbage truck is specifically designed for the collection or garbage and economically performs that operation because it is never used to carry the filled containers to the dumps. However, in the known garbage truck, the conveyors leading from the chute to the receiving opening of the container extend under the driver's cab, so that the latter is disposed on a relatively high level. Thus, the driver does not have a good view of the street and the garbage cans placed alongside the street. In addition, the garbage cans to be emptied must be moved to a location at the front end of the garbage truck before they can be picked up and tipped by the lifting and tipping apparatus.

SUMMARY OF THE INVENTION

It is an object of this invention to provide a garbage truck of the kind first described hereinbefore which is so improved that the garbage cans placed on the street can be coupled to the lifting and tipping apparatus and emptied into the chute in a simple manner without moving them to a location at the front end of the truck, so that the collecting work can be performed by the driver alone.

This object is accomplished, in part, in accordance with the invention by providing a pouring unit which is disposed in part above the driver's cab of the garbage truck and in part between the driver's cab and the container, the chute thereof being disposed in a region extending behind and above the driver's cab and including lifting and tipping apparatus which comprises at least one lifting arm pivotally movable about a transverse pivot carried by the pouring unit or the chassis of the vehicle, the lifting arm carrying at its free end a carrying rail which is parallel to the transverse pivot and pivotally movable between a pick-up position, in which the rail is disposed below and in front of the driver's cab, and a pouring position, in which the rail is disposed above and behind the driver's cab, the rail being provided with displaceable and/or pivotally movable, extensible means such as a coupling or gripping member for coupling to or gripping a garbage can placed on the street. In view of the fact that the pouring unit is disposed above and behind the driver's cab, the cab can be so arranged to provide the driver with an optimum view of the street and the garbage cans placed alongside the street. The driver can collect the garbage by himself without the assistance of other persons and without leaving his seat since the lifting and tipping apparatus is provided with means which can be controlled by the driver from his seat and which can be coupled to or grip a garbage can which has been placed near the route of the truck. As a result, each garbage can be picked up, tipped, emptied and returned to the street without need for manual work. For this reason, the garbage truck in accordance with the invention, facilitates the collection of garbage and permits such collection to be carried out by a single person and the truck to be utilized to a high degree of efficiency.

Since garbage trucks must often move in narrow and crooked streets, the garbage truck in accordance with the invention suitably has a short wheelbase for high maneuverability.

In a garbage truck according to this invention, the driver has a particularly good view of the street and of the garbage cans placed alongside the street since the driver's cab is disposed on the lowest possible level in front of the front axle of the truck. The garbage truck is suitably provided with left-hand and right-hand steering wheels so that in normal street traffic, e.g., when moving to the central container-handling station or to a nearby dump, the driver can use the left-hand steering wheel, and, during the collection of garbage from garbage cans placed along the right side of the street, he can use the right-hand steering wheel.

In accordance with a further feature of the invention the lifting arm consists of two U-shaped members disposed on opposite sides of the driver's cab, each comprising a short leg and a long leg, the transverse pivot for the lifting arm being disposed near the free ends of the short legs and the coupling members carrying the carrying rail being pivoted at one end to the free ends of the long legs, whereas the other ends of the coupling members are connected to the pouring unit or the garbage truck by means of coupling rods that are pivotally attached to levers mounted adjacent to the inner ends of the legs. The connections of the other ends of the coupling members to the pouring unit or the garbage truck are so arranged that the carrying rail when pivotally moving to a position above and in front of the driver's cab will undergo substantially no rotation relative to the driver's cab, but will perform an accelerated rotary movement during its remaining pivotal movement to the chute, such arrangement being also suitable for use in other garbage trucks. The described kinematic arrangement of the lifting and tipping apparatus ensures that there will be substantially no rotation of the garbage can during the major part of the lifting movement so that no garbage can fall out of the can. The accelerated rotation or turning movement during the last part of the movement towards the chute and an impact of the lifting arms or of the garbage can against a stop, or a braking of the movement, during the final phase of the pouring movement, or even an accelerated reverse movement of the garbage can will have the effect of virtually throwing the garbage from the can into the chute.

In accordance with another feature of the invention, a link is eccentrically mounted on the carrying rail for pivotal movement about a vertical axis. At its free end, the link is provided with a claw for picking up a garbage can, the claw being pivotally movable between an outer position and an inner position in which it engages the carrying rail. Due to such arrangement, the driver of the garbage truck can cause the gripping or coupling elements of the lifting and tipping apparatus to grip, tip and return garbage cans standing on the side of the street. The gripping claw suitably consists of a member having the configuration of an isosceles triangle, which has an upwardly directed apex and which is pivoted on a vertical pin of the coupling member. The claw can be introduced into a correspondingly shaped receiving groove on the garbage can and will center itself during such operation.

In accordance with a preferred further feature, the pick-up claw is guided by and axially displaceable on the vertical pin against a spring force and is locked to that pin when the claw is in its lowermost end position. During the introduction of the gripping claw into the receiving groove, the pick-up claw centers itself as it engages the adjacent wall of the can. The pick-up claw will be latched to the carrying pin under the weight of the garbage can which has been gripped. As a result, the garbage can is fixed to the carrying rail of the lifting and tipping apparatus by means of a latching member during the tipping of the can.

In accordance with a particularly advantageous feature, either the link and the auxiliary link are, or only the main link is, movably mounted on a carrier or on a profiled sleeve which is displaceably mounted on the carrying rail and can be extended beyond at least one end of the rail. The sleeve can be extended by special drive means and can be used for gripping and tipping garbage cans even when they have been placed at a relatively distant point from the side of the garbage truck.

In accordance with another feature of the invention, the transfer and compacting chamber is disposed below the receiving space and contains a compacting ram which conforms in cross-section to the chamber configuration and is reciprocable therein by means of laterally disposed toggle joints which are pivoted to the rear end of the ram and adjacent to the rear wall of the chamber. Crossing hydraulic piston-cylinder units are provided, each of which is pivoted at one end to the hinge of each one of the toggle joints and which is pivoted at its other end adjacent to the stationary pivots of the respective other toggle joint. The described conveying and compacting apparatus permits the garbage to be initially pushed into the containers at a relatively high speed and during the final part of the pushing movement, the ram will move at a lower speed and exert a stronger force on the garbage to compact it. A special advantage resides in the fact that the ram is moved by a mechanism which comprises toggle joints and fluid-operable piston-cylinder units which can be retracted to a very small axial length so that the mechanism is compact and economical.

In accordance with another advantageous feature, an auxiliary frame lies on and is pivoted to the main chassis frame, the container being releasably latched to the auxiliary frame and the auxiliary frame is pivoted on pins which are displaceable in slots formed in the rear portion of the main frame. The auxiliary frame is provided at its forward end with a nose which extends below and engages a stop plate on the main frame when the nose is at the forward end position of the auxiliary frame. The auxiliary and main frames are interconnected by an inclined hydraulic piston-cylinder unit in such a manner that the nose is disengaged from the overlying stop before the pivotal movement of the auxiliary frame begins. Due to such arrangement, the container can be emptied by pivotal movement of the auxiliary frame in the conventional manner. In addition, the container can be detached from the auxiliary frame by means of quick-acting couplings so that the filled containers can quickly and easily be replaced by empty containers in the system for collecting garbage in detachably mounted containers.

BRIEF DESCRIPTION OF THE DRAWINGS

Further advantageous features of the invention will be apparent from the following description thereof taken in conjunction with the accompanying Drawings wherein.

DETAILED DESCRIPTION OF THE PREFERRED EMBODIMENT

An illustrative embodiment of the invention will now be explained more in detail with reference to the Drawings.

Figure 1:
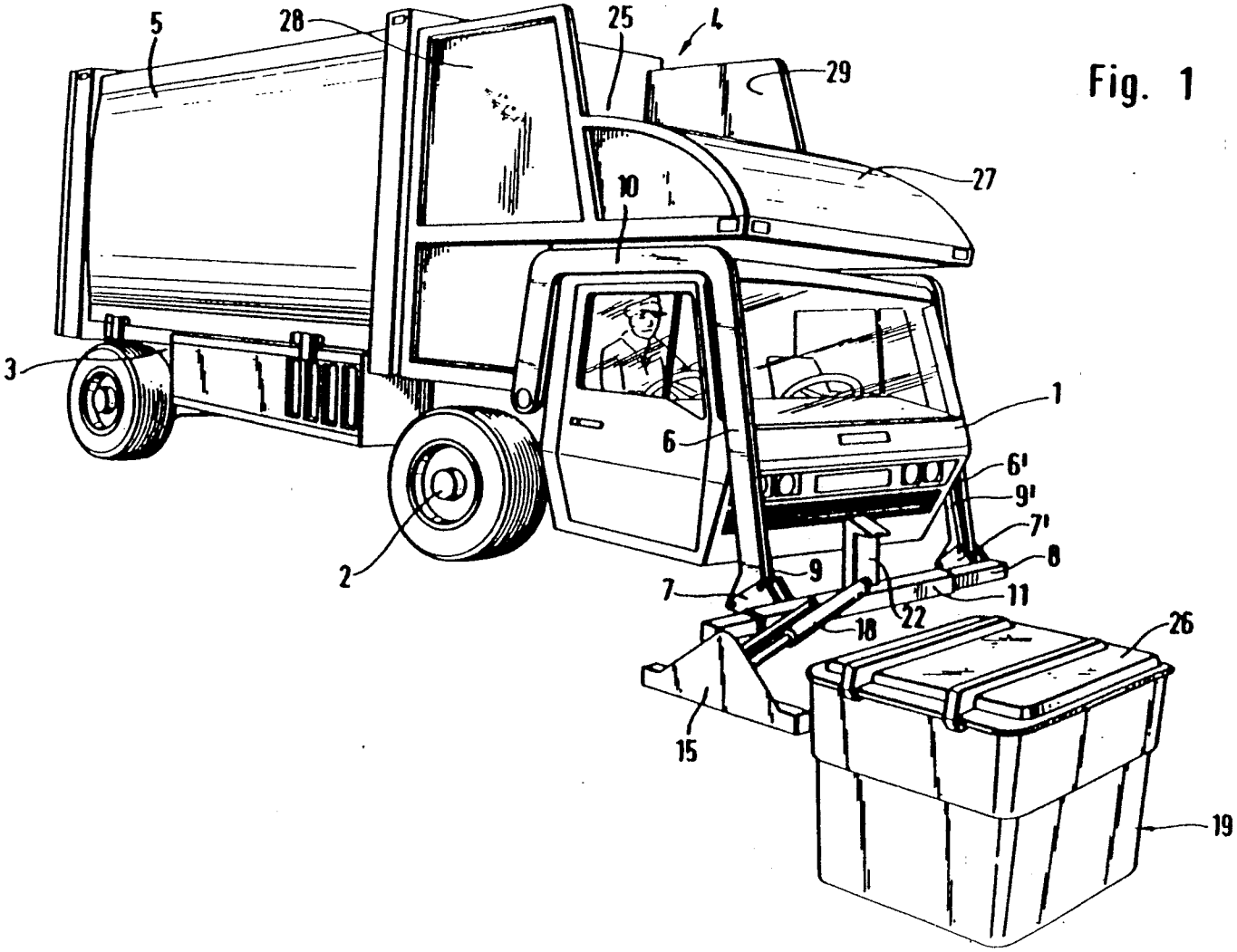
FIG. 1 is a perspective view showing a garbage truck approaching a garbage can to be emptied.
Figure 2:
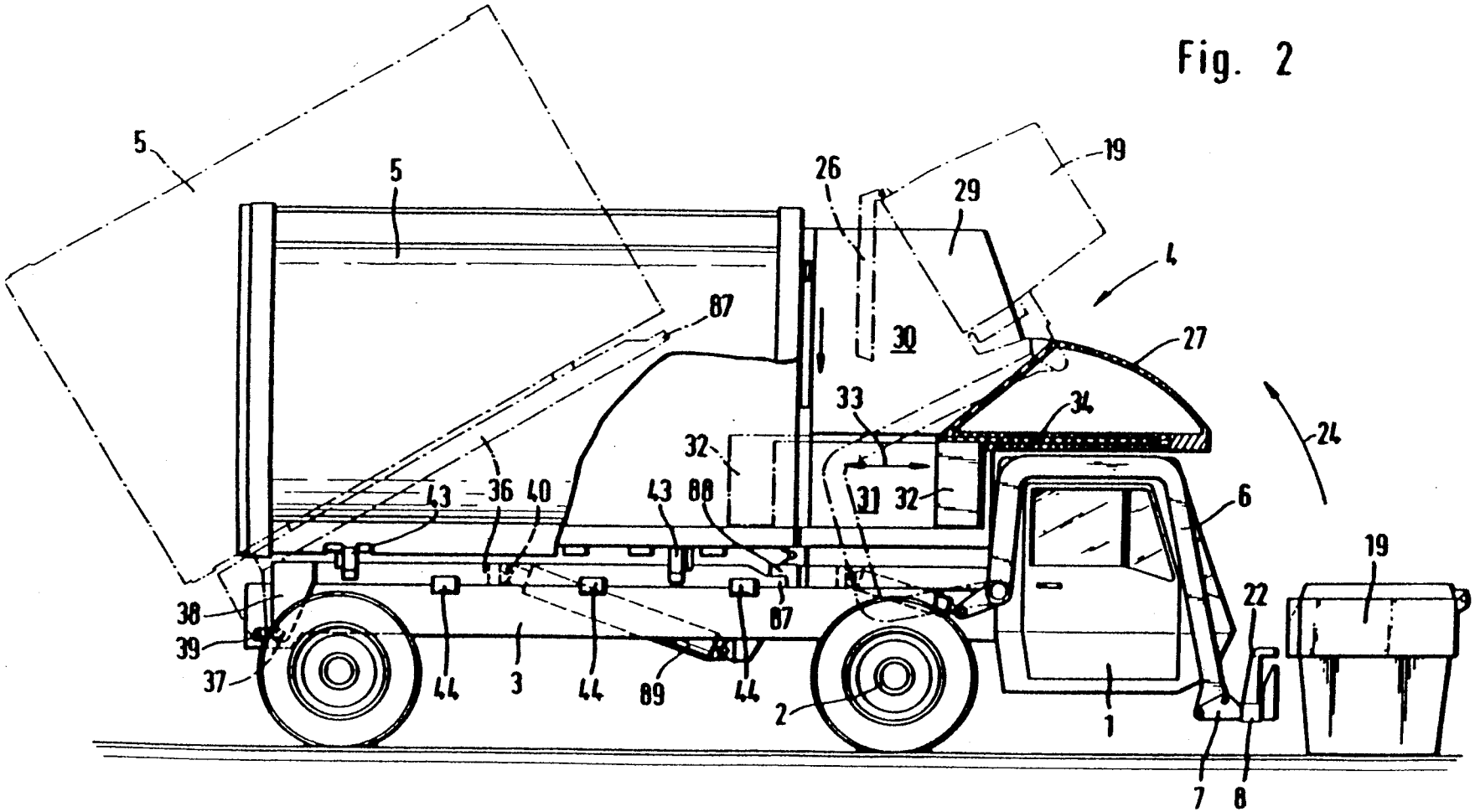
FIG. 2 is a side elevation showing partially in a diagrammatical sectional view the garbage truck of FIG. 1.
Figure 3:
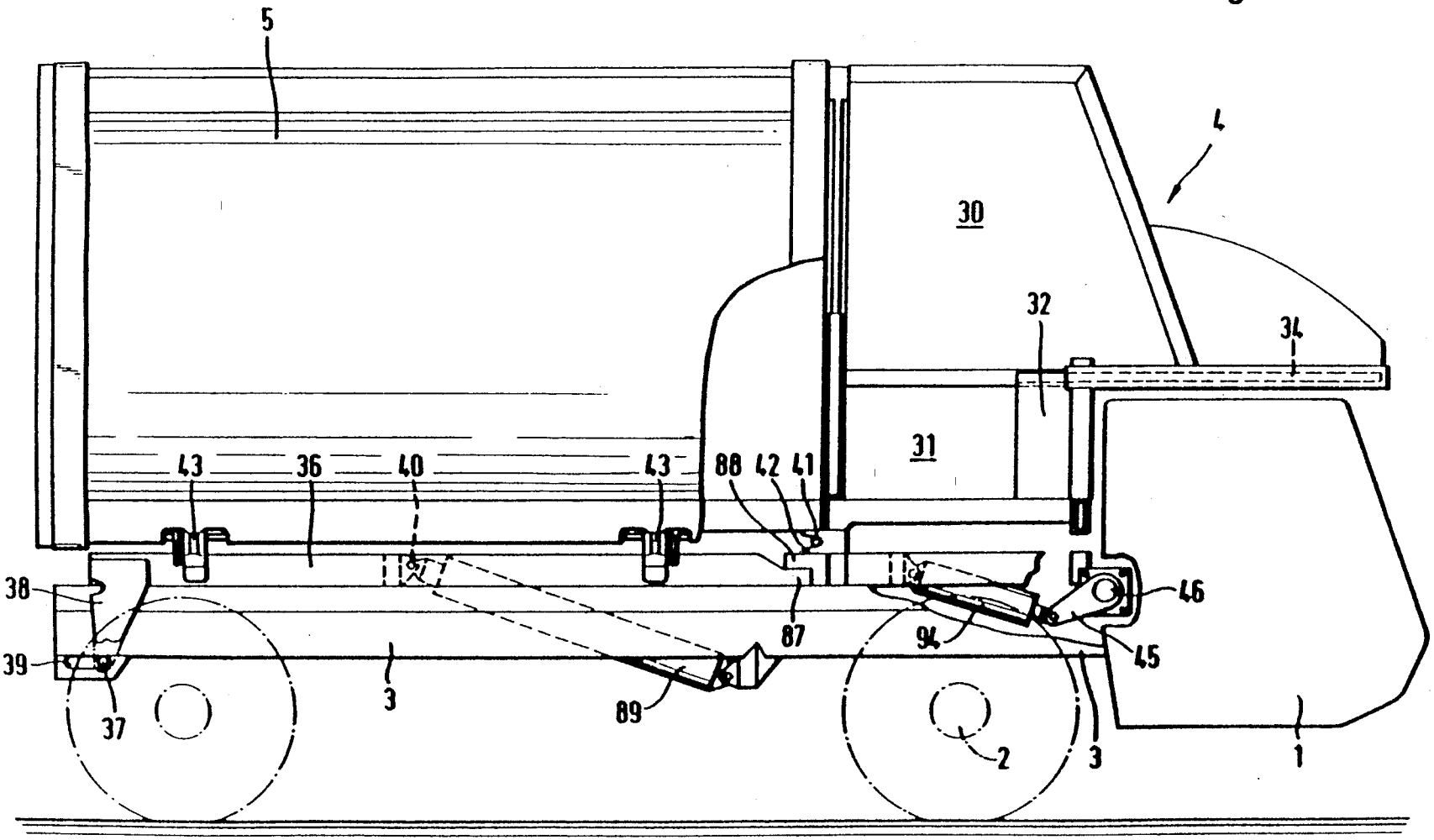
FIG. 3 is a side elevation similar to FIG. 2 and shows the garbage truck in section so that details become more clearly apparent.

A garbage truck of a system for collecting garbage in detachably mounted containers is generally shown in FIGS. 1 to 3. The truck has a short wheelbase for high maneuverability during the collection stage. The driver's cab 1 is secured to the main frame 3 of the chassis and is disposed on a low level in front of the front axle 2. The bottom of the driver's cab is disposed on or below the level of the wheel axles so that the driver has a good view of garbage cans placed alongside the street. As is apparent from FIG. 1 the garbage truck is provided with two steering wheels for left-hand and right-hand steering. During normal traffic in the street, the driver can use the left-hand steering wheel. For the collection of garbage, he can sit on the right in the driver's cab, i.e., on the side on which the garbage cans have been placed.

The pouring unit 4 is connected to the chassis frame 3 of the truck in such a manner so that it is disposed between the driver's cab 1 and the container 5 and extends above the driver's cab 1.

The lifting and tipping apparatus comprises two U-shaped pivoted arms 6, 6' disposed on opposite sides of the driver's cab which have short legs that are pivoted on a pivot 46, which is disposed behind the driver's cab and is mounted in the lower portion of the pouring unit 4 or on the chassis, as shown in FIG. 3. Coupling members 7, 7' are provided, which are pivoted at one end to the free ends of the longer legs of the U-shaped arms 6, 6' and are interconnected by a carrying rail 8 which is parallel to the wheel axles of the truck. Coupling members 7, 7' are pivoted at their other ends to links 9, 9' of the link-lever system by which the rotation performed by the carrying rail 8 during the pivotal movement of the lifting arms 6, 6' is controlled in such a manner that the carrying rail undergoes substantially no rotation relative to the garbage truck until the rail has been pivotally moved approximately to the level of the upper portion of the driver's cab, after which the rail performs an accelerated rotation during the remainder of its pivotal movement. The link-lever mechanism will be explained more in detail hereinafter with reference to FIG. 9.

The U-shaped pivoted lifting arms 6, 6' are designed so that in the lower end position of the arms, the short legs are disposed behind the rear wall of the driver's cab and the forward longer legs are disposed laterally of the forward portion of the driver's cab. The legs of each of the arms are connected by a cross-piece 10, which extends above the side doors of the driver's cab. As a result, the lifting arms do not obstruct the view of the driver of the opening and closing of the doors of the driver's cab.

Figures 4, 4A, 4B, 4C:
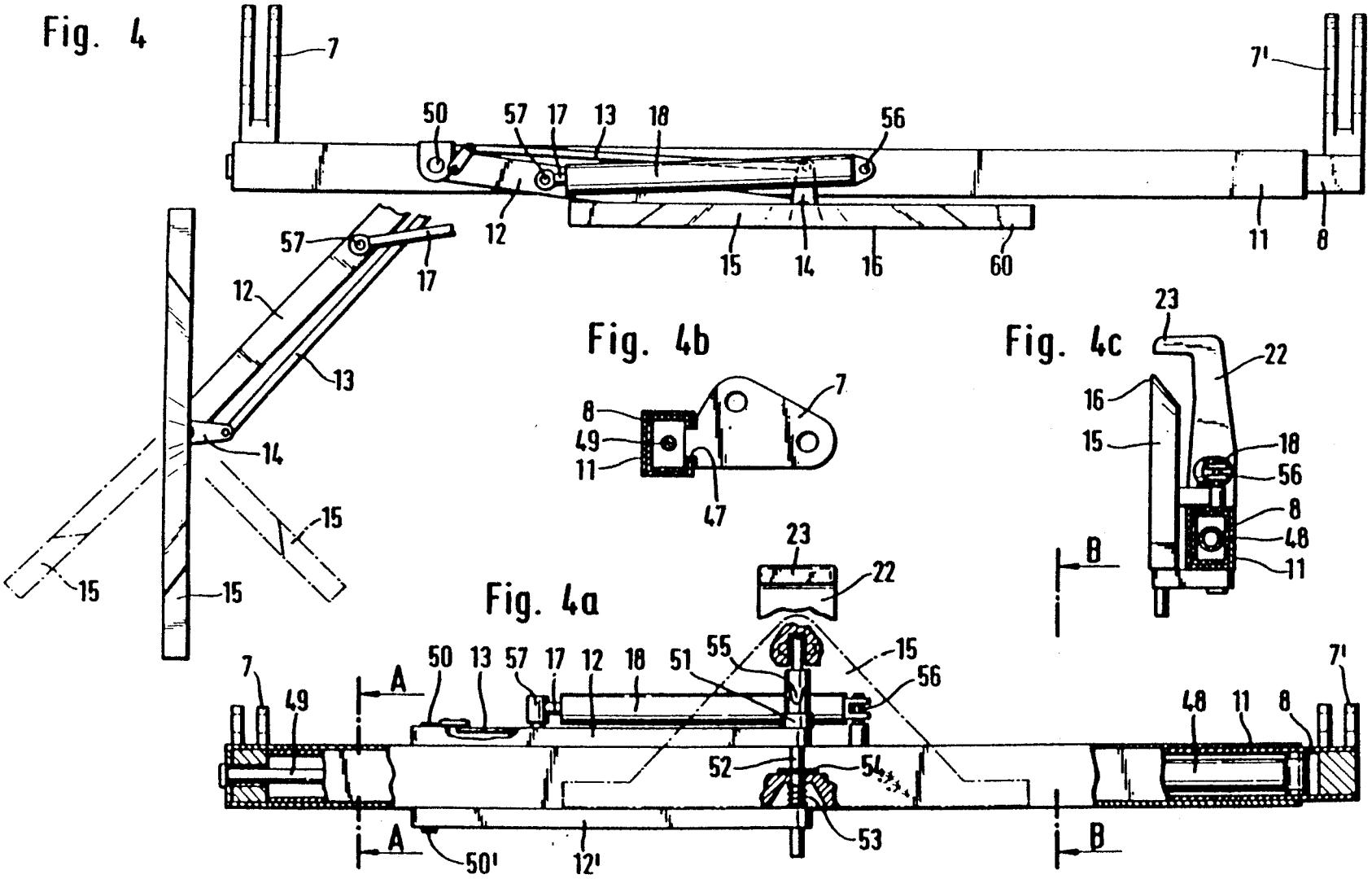
FIG. 4 is a top plan view showing the carrying rail of the lifting and tipping apparatus and the garbage can coupling means in inturned and outturned position.
FIG. 4*a* is a front elevation view showing the carrying rail of FIG. 4 partially in section.
FIG. 4*b* is a sectional view taken on line A—A of FIG. 4*a* and showing the carrying rail.
FIG. 4*c* is a sectional view taken on line B—B of FIG. 4*a* and showing the carrying rail.
Figure 5:
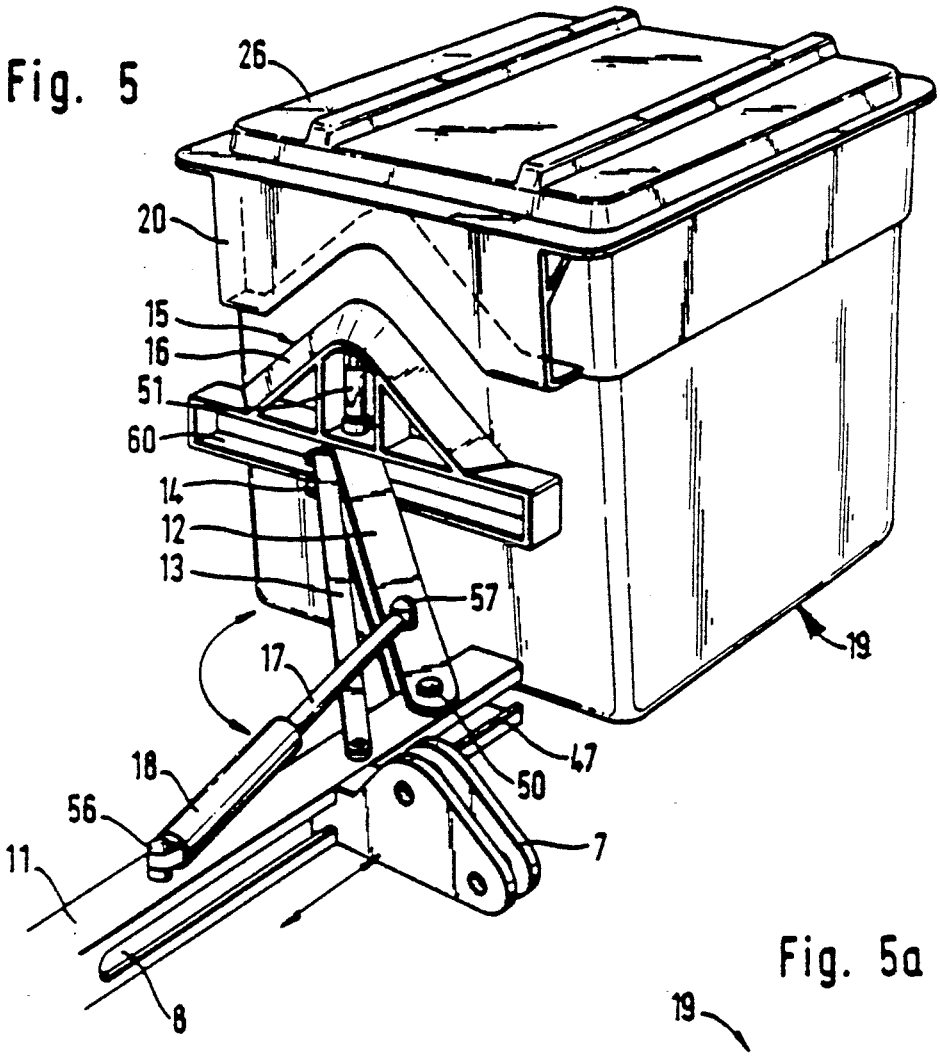
FIG. 5 is a partial perspective view showing a garbage can and the gripping device shown in FIG. 4 just before the can is gripped.
Figure 5A:
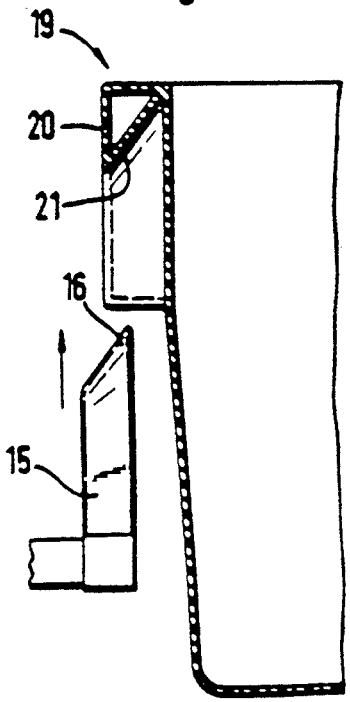
FIG. 5*a* is a partial diagrammatic sectional view showing the coupling portions of the garbage can and the coupling device.

As is clearly apparent from FIGS. 4 and 5, a profiled sleeve 11, which is rectangular in cross-section, is longitudinally slidably mounted on the box-section carrying rail 8. A hydraulic piston-cylinder unit for extending and retracting the profiled sleeve 11 is incorporated in the carrying rail 8. A main link 12 and an auxiliary link 13 are pivoted to the profiled sleeve 11 and are pivoted at their other ends to a coupling member 14, which carries a triangular gripping claw 15 having a wedge-shaped gripping edge 16. The piston rod 17 of a hydraulic cylinder 18 is pivoted to the main link 12. The hydraulic cylinder 18 is pivoted to the profiled sleeve 11 as is shown in FIG. 5 so that the gripping claw can be pivotally moved between an outer position and a position in which the claw 15 centrally engages the profiled sleeve 11.

To permit each garbage can 19 to be lifted and tipped it is provided at its top rim with a profiled reinforcing bar 20 formed at its lower edge with an angled undercut receiving groove 21, which is complementary to the wedge-shaped gripping edge 16 of the gripping claw 15. To couple the can 19 to the lifting and tipping apparatus the gripping claw 15 is introduced into the mating receiving groove 21 so that the claw 15 centers itself. When the can has been coupled to the gripping claw 15, the latter is pivotally moved to its lifting and tipping position, in which the claw 15 centrally engages the profiled sleeve 11. A latching member 22, (FIGS. 4*a* and 4*c*), which protrudes over the carrying rail 8, is secured to the latter or to the profiled sleeve 11 and has an angled upper nose 23 which extends over and engages the top rim of the can or the upper edge of the profiled reinforcing member 20 which is formed with the receiving groove 21, so that the can is latched to the lifting and tipping apparatus. The thus latched can 19 is raised in the direction of the arrow 24 in FIG. 2 and its contents are poured into the chute 25 of the pouring unit 4. Due to the kinematic arrangement of the link-lever mechanism for rotating the carrying rail 8, the can 19 initially remains in a substantially vertical orientation as it is raised so that no garbage can fall out of it. Since an accelerated rotation is imparted to the carrying rail 8 only when it is in close proximity to the chute 25, the cover 26 of the can then opens and the garbage is virtually thrown in the chute as the lifting arm or the can strikes against a stop, or the movement of the lifting arms is reversed.

When the garbage cans to be emptied have been placed along the right side of the street, they can be coupled to the lifting and tipping apparatus under the control of suitable control devices within the reach of the driver on his seat so that the collection of garbage can be effected by the driver of the truck alone without leaving his seat or performing hard or dirty work for the purpose.

A ramp 27 consisting of a curved metal plate extends above the driver's cab 1 toward the chute 25. The ramp is curved around a transverse axis of the garbage truck in such a manner that the carrying rail 8 and the profiled sleeve 11 move over the ramp 27 at a small distance therefrom as the container 19 is tipped. The carrying rail 8, or the profiled sleeve 11 is provided with a suitable scraping edge. Consequently, any garbage which has prematurely fallen out of can 19 onto ramp 27 will be pushed by the scraping edge into the chute 25 as the container 19 is raised towards the chute.

Chute 25 comprises sides walls 28, 29 and is succeeded by a space 30 for receiving the garbage which has been poured therefrom. The lower portion 31 of the receiving space constitutes a transfer chamber in which compacting ram 32 is reciprocable in the directions of the double-headed arrow 32. Compacting ram 32 is shown in an exaggerated width only for the sake of clarity and is provided at its top with a cover plate 34 which separates the transfer and compacting chamber 31 from the upper region of the receiving space 30 as the compacting ram 32 is advanced. During the retraction of the compacting ram 32, the cover plate 34 slides in a track over the driver's cab 1 as is shown in FIG. 1 so that additional garbage can now fall from the upper region of the receiving space 30 into the transfer and compacting chamber 31.

The compacting ram 32 pushes the garbage into the container 5 through an opening in the latter. The opening in the container can be closed by gates, not shown, which can be actuated by fluid-operated piston-cylinder units, not shown, and which are located in the pouring unit 4 and provided with suitable pawls and/or coupling means.

As is apparent from FIGS. 2 and 3 an auxiliary frame 36 lies on and is pivoted to the main frame 3 of the chassis. The pivot 37 of the pivoted frame 36 is carried by an angled extension 38 at the rear end of the pivoted frame and is guided in a slot 39 formed in the main frame 3. The pivoted frame 36 is provided at its forward end with a flat nose 87 which is adapted to extend below and engage an angle bar 88 connected to the main frame. In this manner pivoted frame 36 is locked to the main frame 3. The cylinder 89 of a fluid-operable piston-cylinder unit is pivoted to the main frame 3 and is provided with a piston rod pivoted to frame 36 by a pin 40. When suitable latching means have been released, the fluid-operable piston-cylinder unit 89 can be operated to initially push the pivot frame 36 to the rear on the main frame 3 until the pin 37 engages the rear end of the slot 39 in the position shown in FIG. 2. In that position the nose 87 has cleared the overlying flange of the angle member 88 so that the pivoted frame 36 can now be pivotally moved as is indicated in FIG. 2 in order to discharge the contents of the container.

Container 5 is provided at its forward end with a latch pin 41 which interlocks with a latch hook 42 of the pouring unit 4.

The container 5 is latched to the pivoted frame 36 by latching means 43 and is centered by laterally disposed jaws 44. When the latching means 41, 42, 43 have been released and the opening of the container has been closed, the container can be lifted from the garbage truck and transferred to suitable forwarding truck for forwarding to a suitable dump.

FIGS. 2 and 3 show also hydraulic cylinder 94 which is pivoted to the chassis and has a piston rod that is pivoted to the lever 45 for imparting a pivotal movement to the pivoted arms 6, 6' about the pivot 46.

The gripping unit of the lifting nd tipping apparatus, inclusive of the gripping claw 15, will now be explained more in detail with reference to FIG. 4.

In the position shown in FIG. 4, the pivotal connections between the coupling members 7, 7' and the lifting arms 6, 6', on the one hand, and the outer links 9, 9', on the other hand, are separated. The profiled sleeve 11 has been slidably fitted onto the carrying rail 8, which interconnects the coupling members 7, 7'. In the embodiment shown by way of example, the profiled sleeve 11 can be extended only to the left in FIG. 4 and only to the right in FIG. 5 and the gripping claw 15 can be pivotally moved from its central position on the profiled sleeve only in the direction of that displacement. As a result, the driver of the garbage truck can take up and empty only garbage cans placed on the right side of the street. For this reason the garbage truck is provided with a steering wheel on the left for normal traffic in the street and also with a right-hand steering wheel for use during the taking and emptying of garbage cans.

As is apparent from FIG. 5 the profiled sleeve 11 is formed on the rear side with a slot 47 in its portion, so that the sleeve can be displaced to the right to protrude beyond the coupling member 7 by about 1.20 meters. This is apparent from FIG. 4*a*, which shows that the cylinder 48 of a hydraulic piston-cylinder unit is secured to the left -hand portion, when viewed in the direction of travel, of the box-section carrying rail 8. The piston rod of that piston-cylinder unit is secured to the extensible end of sleeve 11.

The upper and lower main links 12, 12' are pivoted by means of pins 50, 50' disposed on sleeve 11. The outer end of the link 12 is pivoted to a pin 51, which is secured to the coupling member 14. Pin 51 is formed with a bore in which a pin 52 carrying the gripping claw is longitudinally displaceable to a limited extent. Pin 52 is surrounded by a spring 53 which bears at its lower end on the lower main link 12' and at its upper end on a stop 54 which is connected to pin 52. The pin and the gripping claw 15 are held against a stop, not shown by means of spring 53 when the gripping claw 15 is not loaded. The tubular pivot pin 51 for the main link 12 is formed at its top end with mutually opposite grooves having side faces connected by rounded surfaces. Pin 52 on which the claw 15 is pivotally mounted is provided at its upper end with noses 55 which are complementary to the grooves of the pivot pin 51 and which are depressed into the grooves against the force of the spring 52 when the gripping claw 15 is loaded by a garbage can so that the gripping claw is then fixed to the coupling member 14. As is apparent from FIG. 4 the unloaded gripping claw can be pivotally moved between stops, not shown, through 45° to the left and right relative to the coupling member 14. When it is desired to pick up a garbage can, it is sufficient to impart a pivotal movement to the gripping claw 15 towards the front side of the garbage can which is provided on the front side of the can with the receiving groove 21. During that operation, the gripping claw 15 assumes such a position relative to the front wall of the can that the claw is in substantially snug contact with the wall. When the gripping claw is subsequently raised, its wedge-shaped gripping edge 16 enters the receiving groove 21 and will be centered in the latter in the transverse direction if the apex of the gripping edge 16 is initially disposed in the receiving groove 21. When the gripping claw is then raised further, it is loaded by the weight of the garbage can 19 so that the spring 53 is depressed, the noses 55 slip into the mating grooves and the claw is locked to the coupling member 14.

As is shown in FIG. 4, the auxiliary link 13 is pivoted to the coupling member 14 and the profiled sleeve 11 at such locations that the gripping claw 15 is pivotally movable between its central position, in which the claw is closely spaced from the profiled sleeve 11, and its outer position shown in FIG. 4.

The respective locations 56, 57 at which the cylinder 8 is pivoted to the profiled sleeve 11 and the piston rod 17 is pivoted to the main link 12 are apparent from FIG. 4.

It is apparent from FIG. 4*c* that the latch rod 22 is centrally connected to the profiled sleeve 11. When the gripping claw 15 is in its inturned position, as shown, the rim of the can or the profiled bar 20 formed with the receiving groove 21 is latched by being gripped between the rounded apex of the gripping claw 15 and the overlying tongue 23 of the latch rod 22.

As is most clearly apparent from FIG. 5, the gripping claw 15 consists of a triangular member which is provided at its base with a profiled lower crosspiece 60. The triangle is isosceles and is rounded at its apex. The gripping edges 16 are constituted by the sides and the apex of the triangle and are inwardly and downwardly inclined.

The can 19 is of conventional type and is provided with a pivot for the hinged cover 26 on that side which is opposite to the coupling bar 20.

Figure 5B:
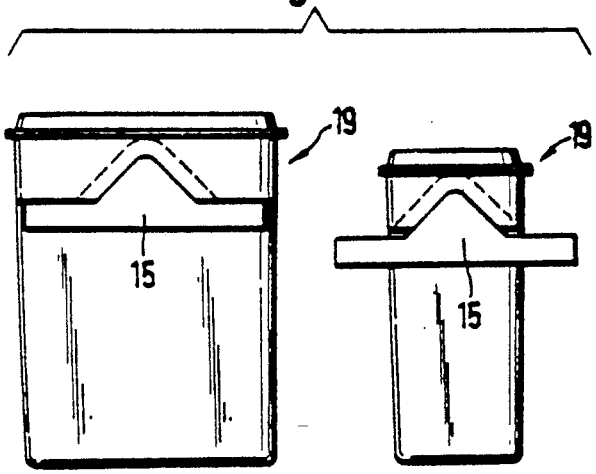
FIG. 5*b* is a diagrammatic view showing two garbage cans differing in size with the coupling elements in coupling position.

Garbage cans differing in size may be provided with the same coupling bar 20 so that the gripping claw 15 of the lifting and tipping apparatus may be used to pick up and tip cans differing in size. For instance, FIG. 5*b* shows a relatively large can and a smaller can of the size generally used in households.

Figure 6:
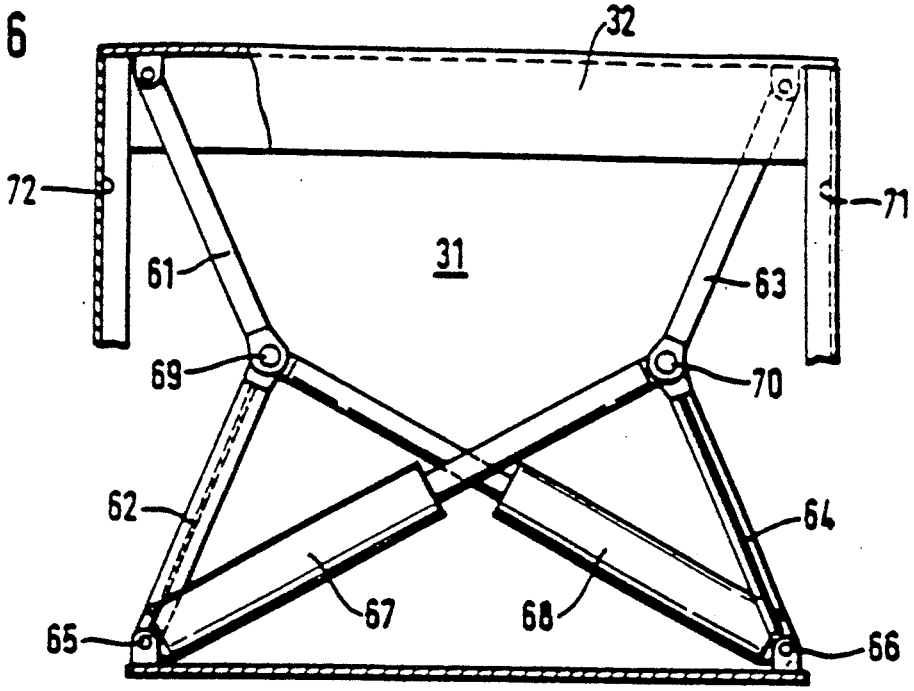
FIG. 6 is a plan view showing the conveying and compacting apparatus.
Figure 7:
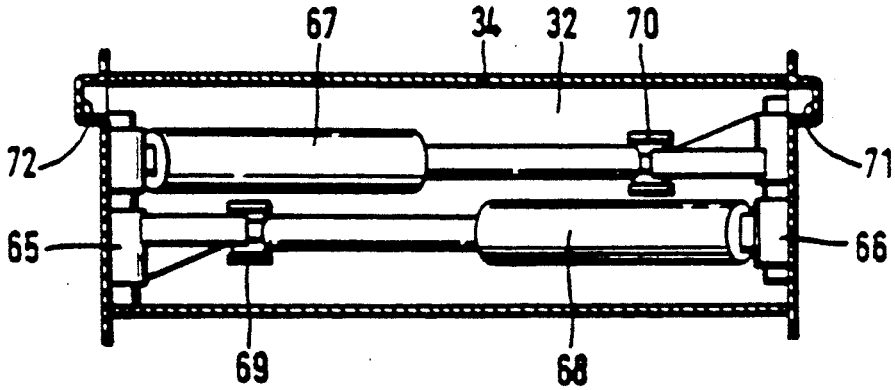
FIG. 7 is a rear view in elevation showing the conveying and compacting apparatus of FIG. 6.
Figure 8:
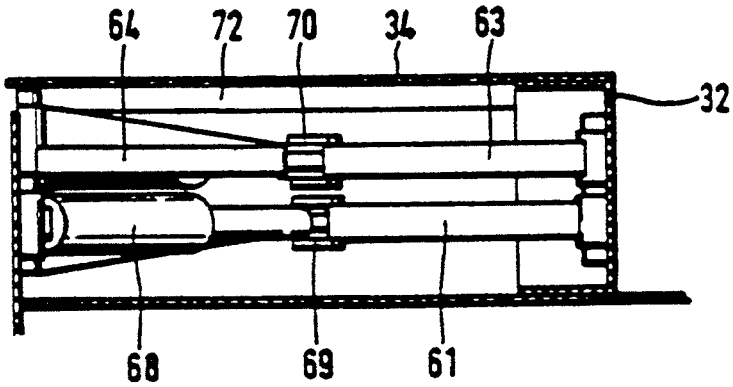
FIG. 8 is a side view in elevation showing the conveying and compacting apparatus of FIG. 6.

The conveying and compacting apparatus will now be explained more in detail with reference to FIGS. 6 to 8.

The extent to which the compacting ram 32 can be displaced in the chamber 31 is apparent from FIG. 2. The compacting ram 32 is connected to two toggle joints constituted by arms 61, 62 and 63, 64 to the forward wall defining the chamber 31. The toggle arms 62, 64 are pivoted on pivot pins 65, 66 provided adjacent the forward wall defining the chamber 31. The cylinders 67, 68 of piston-cylinder units are also pivoted to the pins 65, 66. The piston rods of these units are pivoted to hinges 69, 70 so as to cross each other.

The compacting ram 32 has a rectangular cross-sectional shape which conforms to the cross-section of the chamber 31. Ram 32 is connected to the cover plate 34 of the chamber and is guided in laterally disposed tracks 71, 72. Cover plate 34 and compacting ram 32 confine the transfer and compacting chamber 31 so that the toggle joints and the piston-cylinder units will not be soiled by additional garbage falling into chamber 31. In retracted position the toggle joint and piston-cylinder mechanism has only a short axial length so a compact arrangement can be used.

Figure 10:
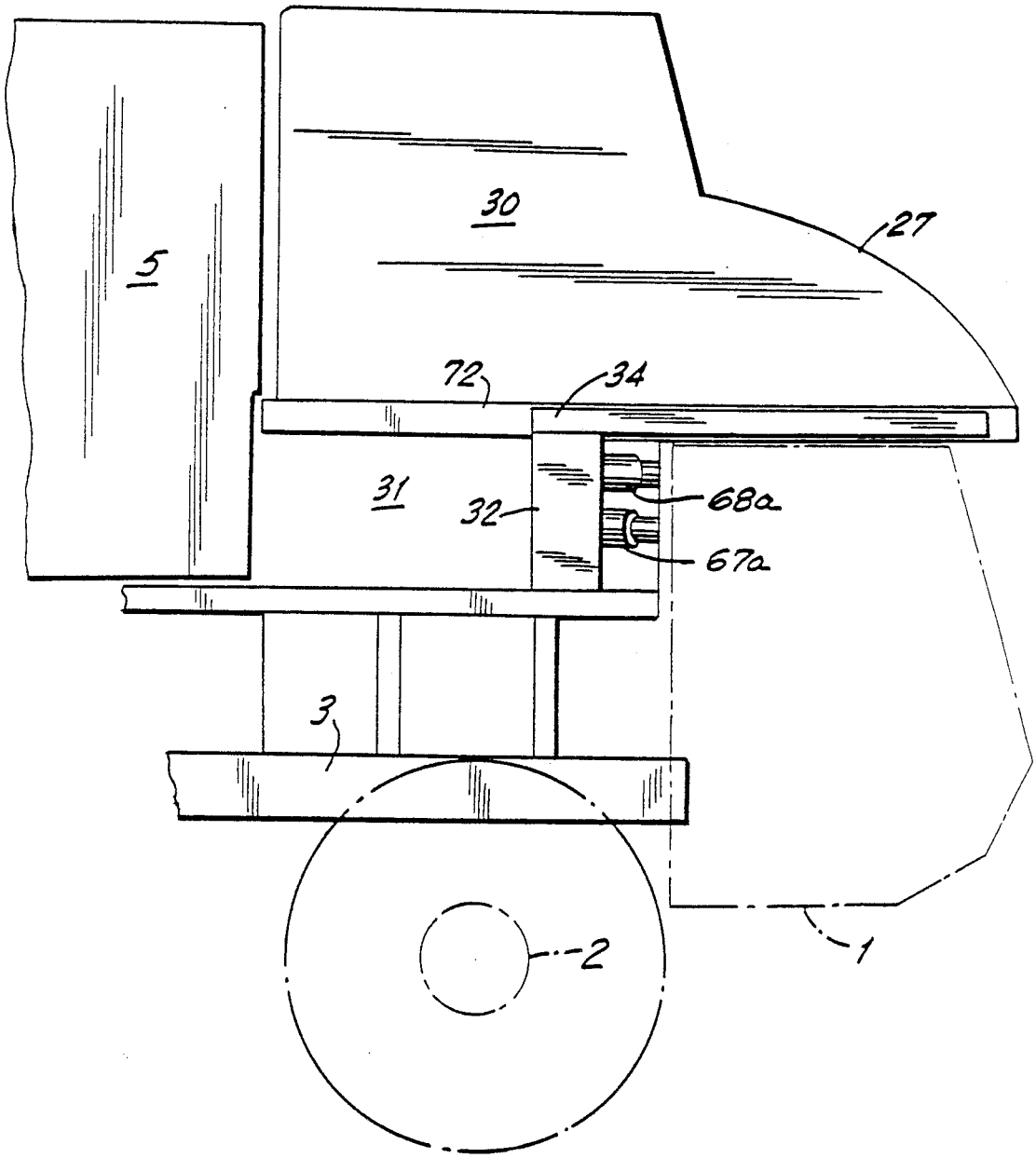
FIG. 10 is a partial, sectional diagrammatic view in elevation of the garbage truck illustrated in FIGS. 2 and 3 showing the relationship between the compacting apparatus including the ram or platen and a modification of the hydraulic piston-cylinder units for conveying the ram or platen.
Figure 11:
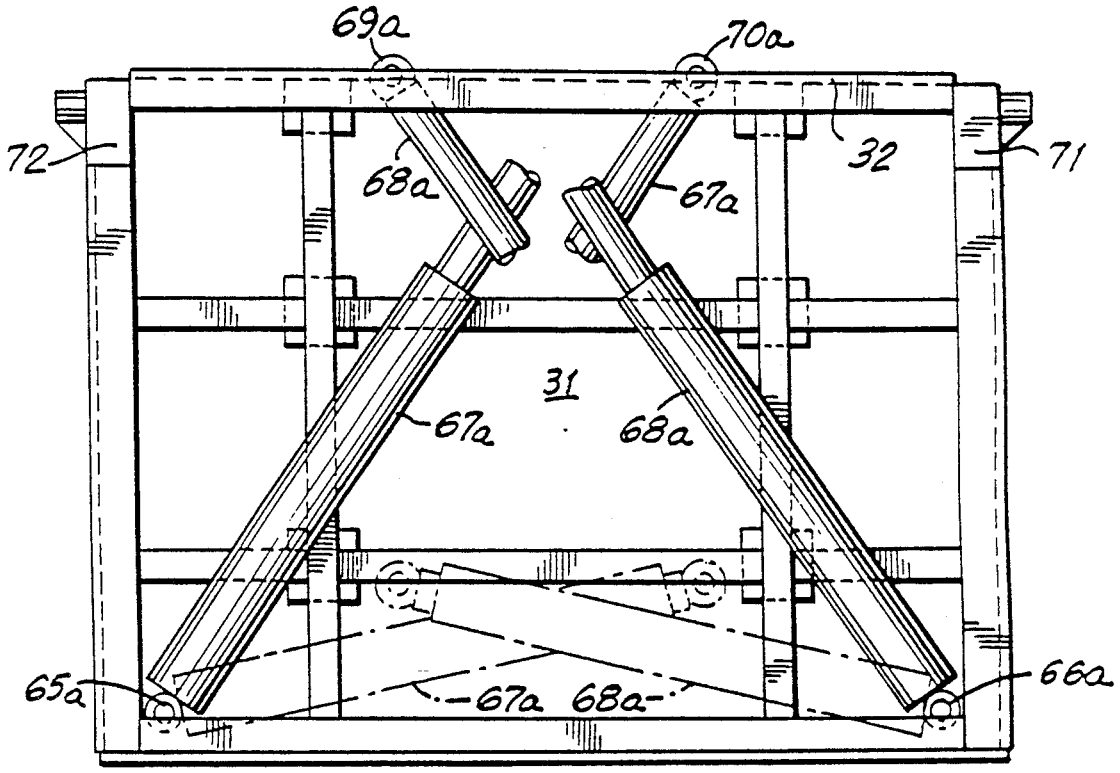
FIG. 11 is a plan view of the compacting apparatus shown generally in FIG. 10 illustrating in detail the crossing hydraulic piston-cylinder units for conveying the ram or platen.

Referring now to FIGS. 10 and 11 and the modification of the compacting and conveying apparatus shown in those Figures, the compacting and conveying chamber 31 is provided behind the driver's cab 1, as previously described. However, the drive unit for the compacting ram or platen 32 differs from that illustrated in FIGS. 6 through 8, the toggle joints described above having been eliminated in this modification. More specifically, the compacting ram or platen 32 is guided in the conveying and compacting chamber 31 by tracks 71 and 72 and which are laterally disposed above chamber 31 and extend above the driver's cab 1, as shown. The cover plate 34 is joined to the compacting ram or platen 32 and extends at a right angle thereto, the ram or platen 32 being reciprocated by crossing hydraulic piston-cylinder units 67*a* and 68*a* and which are pivoted on pivot pins 65*a* and 66*a* provided adjacent the forward wall defining chamber 31. The piston rods of the piston-cylinder units 67*a* and 68*a* are pivoted to pivot pins 69*a* and 70*a* provided on the rear wall of the compacting ram or platen 32 so that the piston-cylinder units cross each other.

As in the previously described arrangement utilizing the toggle joints, the cover plate 34 serves to guide the compacting ram or platen 32 and to close the conveying and compacting chamber 31 when the ram or platen is advanced towards the container 5.

As shown in FIG. 10, the conveying and compacting chamber 31 is disposed above the chassis frame 3 and the front axle 2 and the container 5 is provided on the chassis frame 3 behind chamber 31, as in the arrangement utilizing the toggle joints previously described.

The respective positions assumed by the piston-cylinder units 67*a* and 68*a* when the compacting ram or platen 32 is in its advanced and retracted positions are apparent from FIG. 11.

Figure 9:
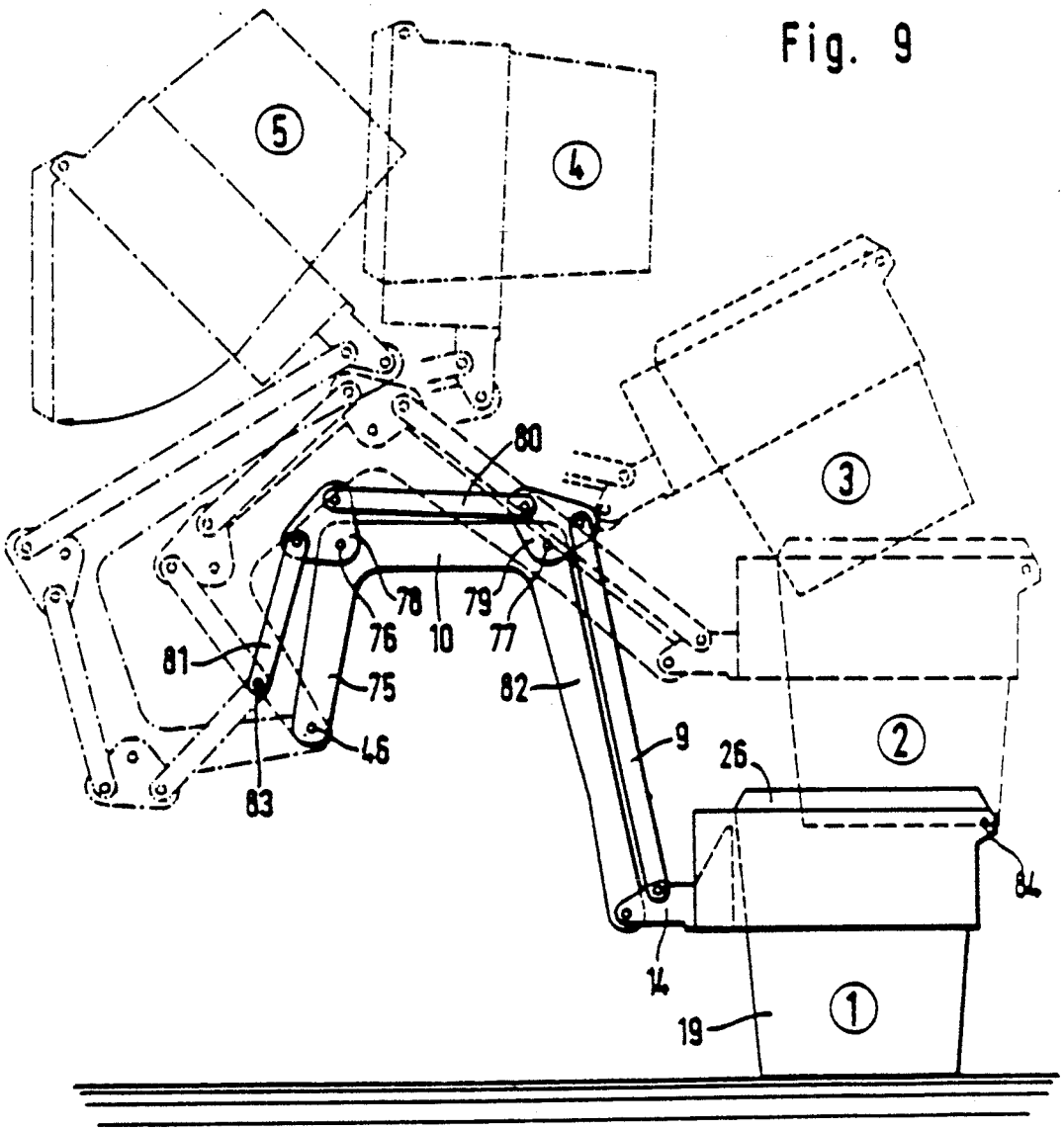
FIG. 9 is a diagrammatic side view elevation showing the lifting arm, as well as the link-lever mechanism for controlling the carrying rail during its pivotal movement, and the coupled garbage can with these elements shown in different positions in broken lines.

The kinematic arrangement of the link-lever mechanism associated with the lifting arms 6, 6' is apparent from FIG. 9, in which a can is shown in five positions, which are successively assumed by the can starting from the position in which the can is picked up to the position in which it is tipped. The shorter leg 75 of each lifting arm is movably mounted on the pivot 46 which is fixed to the frame. Adjacent to the ends of the crosspiece 10, which connects the legs of each lifting arm 6, 6', the approximately triangular lever plates 78, 79 are pivoted on pivot pins 76, 77 in such a manner that the lever plates 78, 79 protrude outwardly beyond the corner portions of the lifting arms. Coupling rods 9, 80, 81 are pivoted to the lever plates near their base corners. Coupling rod 80 extends approximately parallel to crosspiece 10 and connects the two lever plates 78, 79, as illustrated. Coupling rod 9 extends approximately parallel to the longer leg 82 and is pivoted to coupling member 14 associated with the carrying rail. The inner coupling rod 81 is pivoted at its outer end to the lever plate 78 and at its inner end by the pin 83 to the frame. The desired lifting and tipping movement of the can 19 is indicated by container positions 1 to 5. The pivot 84 for the can cover is disposed on that side of the can which is opposite to the coupling members so that the cover will automatically open as the can is tipped in position 5.

Each of coupling rods 9, 80 and 81 together with the coupling member 14, the lever plates, the pivotal connections at the frame, and the legs and the crosspiece of the associated lifting arm constitute a four-bar linkage so that a linkage comprising levers and coupling rods is achieved which has the described characteristics.

What is claimed is:

1. A motor-driven garbage truck including a driver's cab, said truck comprising a container having a filling opening for receiving garbage, a pouring unit fixed to the truck between said driver's cab and said container, extending above said driver's cab and including a receiving chamber having a receiving opening, lifting and tilting means for receiving and emptying garbage from a garbage can into said receiving chamber through said receiving opening, and conveying and compacting means for transporting garbage that has been received through said receiving opening into said container through said filling opening, characterized by the fact that said receiving opening is disposed between the driver's cab of aid truck and said container and a conveying and compacting chamber is disposed below said receiving opening, said conveying and compacting chamber having a compacting platen disposed therein which has cross sectional dimensions that conform to the cross sectional dimensions of said conveying and compacting chamber and which is provided with drive means and is guided to reciprocate substantially horizontally in said conveying and compacting chamber, and a cover plate, joined to the upper edge portion of said compacting platen and extending at a right angle thereto and slidably guided in tracks located above and extending over said driver's cab, reciprocably disposed over said conveying and compacting chamber and reciprocating substantially horizontally thereover, whereby said conveying and compacting chamber is reciprocably opened and closed as said compacting platen is reciprocated in said conveying and compacting chamber and said drive means is protected from becoming soiled by additional garbage falling into said conveying and compacting chamber.

2. A garbage truck according to claim 1 characterized by the fact that the drive means for the compacting platen comprises crossing hydraulic piston-cylinder units pivoted at their ends at spaced apart locations to the forward wall of the conveying and compacting chamber and to said compacting platen.

3. A motor-driven garbage truck including a driver's cab, said truck comprising a container having a filling opening for receiving garbage, a pouring unit fixed to the truck located in the front portion thereof and including a receiving chamber having a receiving opening, lifting and tilting means for receiving and emptying garbage from a garbage can into said receiving chamber through said receiving opening, and conveying and compacting means for transporting garbage that has been received through said receiving opening into said container through said filling opening, characterized by the fact that said receiving opening is disposed between the driver's cab of said truck and said container and a conveying and compacting chamber having forward and rear walls is disposed below said receiving opening, said conveying and compacting chamber having a compacting platen disposed therein which has cross sectional dimensions that conform to the cross sectional dimensions of said conveying and compacting chamber and which is provided with drive means comprising laterally disposed toggle joints pivoted at their ends at spaced apart locations to the compacting platen and to the forward wall of the conveying and compacting chamber, and crossing hydraulic piston-cylinder units each of which is pivoted at one end to a hinge on each of said toggle joints and its other end to a stationary pivot on the respective toggle joint and is guided to reciprocate in said conveying and compacting chamber, and a cover plate, jointed to the upper edge portion of said compacting platen and slidably guided in tracks located above said driver's cab, reciprocably disposed over said conveying and compacting chamber, whereby said conveying and compacting chamber is reciprocably opened and closed as said compacting platen is reciprocated in said conveying and compacting chamber and said drive means is protected from becoming soiled by additional garbage falling into said conveying and compacting chamber.

* * * * *